US006840413B1

(12) United States Patent
Cameron et al.

(10) Patent No.: US 6,840,413 B1
(45) Date of Patent: Jan. 11, 2005

(54) REMOVABLY MOUNTABLE CREASE AND WRINKLE PREVENTION DEVICE

(76) Inventors: Michael James Cameron, 10336 Key Lantern Dr., Newport Richey, FL (US) 34654; Sherry Cameron, 10336 Key Lantern Dr., Newport Richey, FL (US) 34654

( * ) Notice: Subject to any disclaimer, the term of this patent is extended or adjusted under 35 U.S.C. 154(b) by 178 days.

(21) Appl. No.: 10/290,990

(22) Filed: Nov. 8, 2002

(51) Int. Cl.[7] ..... A41D 27/22
(52) U.S. Cl. ..... 223/98
(58) Field of Search ..... 223/98

(56) References Cited

U.S. PATENT DOCUMENTS 2,091,506 A * 8/1937 Guttridge ..... 223/98
3,179,315 A 4/1965 Sieradzki
5,056,694 A 10/1991 Michalik
6,012,620 A * 1/2000 Murray ..... 223/98
6,126,049 A * 10/2000 Gish ..... 223/96
6,213,359 B1 4/2001 Gish

* cited by examiner

*Primary Examiner*—John J. Calvert
*Assistant Examiner*—James G Smith

(57) ABSTRACT

A plurality of crease and wrinkle prevention devices for preventing unwanted creases and wrinkles in articles of clothing best suited for hanging in combination onto a horizontal arm and a plurality of side arms of a clothes hanger respectively. Such wrinkles caused by a smaller hanging surface. The devices having a large cylindrical hanging surface, and being longer than the horizontal arm, and the side arms, removably install and securely contour onto the arms through a molded gap, after cutting off a portion of the devices exceeding the length of the arms. The longer length of the devices allows them to be used on clothes hangers in existing collections, having horizontal arms and side arms varying in length resulting from differently manufactured clothes hangers.

12 Claims, 3 Drawing Sheets

REMOVABLY MOUNTABLE CREASE AND WRINKLE PREVENTION DEVICE

BACKGROUND OF THE INVENTION

1. Field of the Invention

This invention relates mainly to devices used to prevent unwanted creases and wrinkles for a portion of clothing resting on a clothes hanger.

2. Description of the Prior Art

As a result of the standard wire, plastic, and wooden clothes hangers currently manufactured, many people are discouraged by the prospect of having to re iron already ironed pieces of clothing, in order to straighten out unwanted creases and wrinkles, resulting from the ironed pieces being placed onto a standardly manufactured clothes hanger for future use. Over the years there have been several clothes hangers developed, as well as several attachments developed to be used in combination with a clothes hanger in an effort to counteract this problem, however at the same time overlooking several prevalent concerns that some consumers have. For instance, U.S. Pat. No. 6,012,620 to Murray addresses the crease and wrinkle problem for articles of clothing best suited for hanging onto the side arms of a clothes hanger such as coats, blouses, and shirts, by mounting to the side arms, a removable attachment having a larger surface for the article of clothing to rest on than that of the side arms. Murray does not address the crease and wrinkle problem, for articles of clothing best suited for hanging onto a horizontal arm of a clothes hanger such as pants, dress slacks, and shorts. Murray's device fails to solve the problem that consumers have, of how to make the existing clothes hangers in their vast collection completely crease and wrinkle proof, when the two types of clothing are hung onto the same hanger in combination, as many consumers do with regularity. U.S. Pat. No. 6,126,049 and 6,213,359 B1 to Gish addresses the crease and wrinkle problem for articles of clothing best suited for hanging onto a horizontal arm of a clothes hanger such as pants, dress slacks, and shorts, by gluing an attachment having a larger cylindrical surface for the article of clothing to rest on, to the smaller cylindrically surfaced horizontal arm. The device does not address the crease and wrinkle problem for articles of clothing best suited for hanging onto the side arms of a clothes hanger such as coats, blouses and shirts. Gish creating a modified clothes hanger that is partially effective, when the two types of clothing are hung onto the same hanger in combination. Gish also fails to solve the problem that consumers have of how to make the existing clothes hangers in their vast collection crease and wrinkle proof. The Gish device made available without the hanger, would make clothes hangers in existing collections partially crease and wrinkle proof, for consumers who hang the two types of clothing onto the same hanger. Neither Murray or Gish providing for any type of fitting adjustment for their devices, when mounting them to side or horizontal arms varying in length, resulting from clothes hangers from different manufacturers in existing collections.

Applicants are aware of the below listed attachments used in combination with a clothes hanger:

Sieradzki, U.S. Pat. No. 3,179,315, Patented Apr 1965.
Michalik, U.S. Pat. No. 5,056,694, Patented Oct 1991.
Murray U.S. Pat. No. 6,012,620, Patented Jan 2000.
Gish, U.S. Pat. No. 6,126,049, Patented Oct. 2000.
Gish, U.S. Pat. No. 6,213,359, Patented Apr 2001.

SUMMARY OF THE INVENTION

Our invention comprises a plurality of innovated light weight crease and wrinkle prevention devices that quickly and efficiently connect to, and disconnect from a horizontal arm and a plurality of side arms of a clothes hanger. They are used for preventing unwanted creases and wrinkles in articles of clothing best suited for hanging in combination onto the horizontal arm and the side arm of the clothes hanger respectively. Such creases and wrinkles caused by a smaller cylindrical surface, or a non-cylindrical surface of a standardly manufactured clothes hanger. Our devices are effectively capable of solving the problem that consumers have, of how to easily make existing clothes hangers in their vast collections, completely crease and wrinkle proof when hanging articles of clothing such as pants and shirts on the same hanger in combination. Various other advantages and features of novelty which characterize our invention are pointed out with particularity in the claims annexed hereto and forming a part hereof. However, for a better understanding of the invention, its advantages, and objects obtained by its use, reference should be had to the drawings which forms a further part hereof, and to the accompanying descriptive matter, in which there are illustrated and described certain preferred embodiments of the invention.

BRIEF DESCRIPTION OF THE DRAWINGS

The invention can be best understood by those having ordinary skill in the art by reference to the following detailed described when considered in conjunction with the accompanying drawing in which.

REFERENCE NUMERALS IN THE DRAWING

20 removably mountable crease and wrinkle prevention device.
21 cylindrical exterior circumference section.
22A fitting adjustment portion of crease and wrinkle Prevention device.
23 cylindrical ends.
24 & 24A plurality of side arms of a clothes hanger.
26&26A horizontal arm of a clothes hanger.
28 molded opening.
30 cylindrical interior surface section.
30A & 30B non-cylindrical interior surface sections.

DETAILED DESCRIPTION OF THE PREFERRED EMBODIMENT

Figure 1:
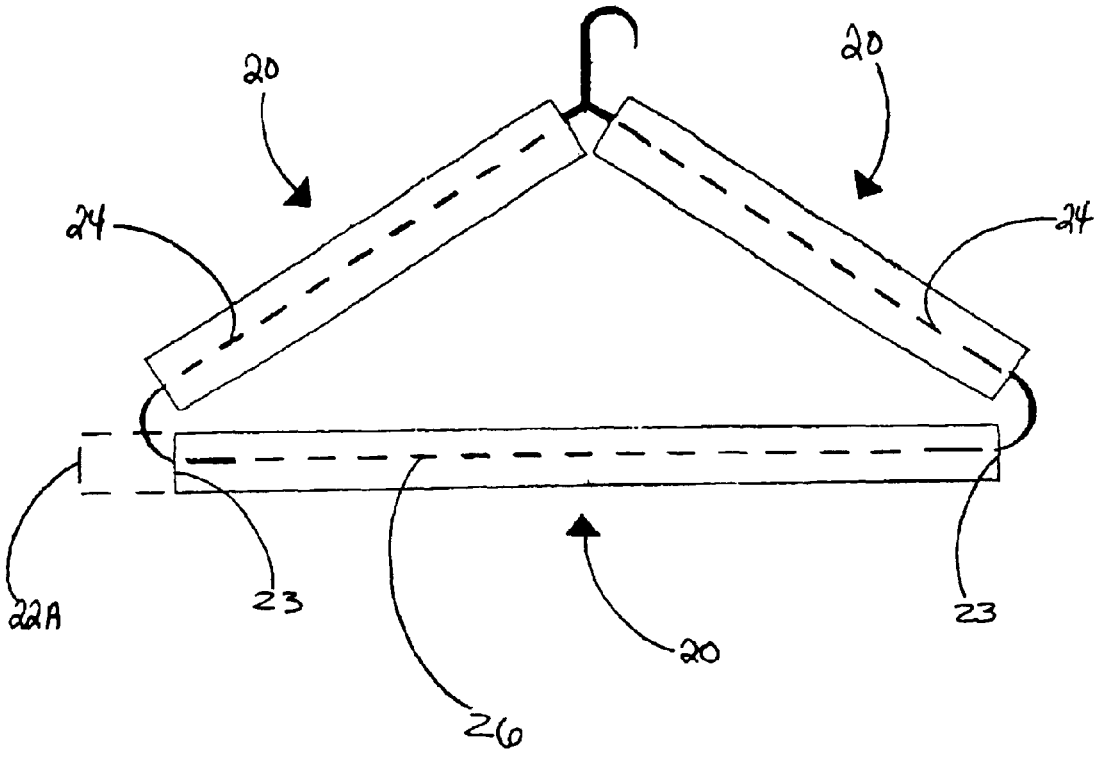
FIGS. 1, 2, and 3 are perspective views of the present invention in operation on a clothes hanger.
Figure 2:
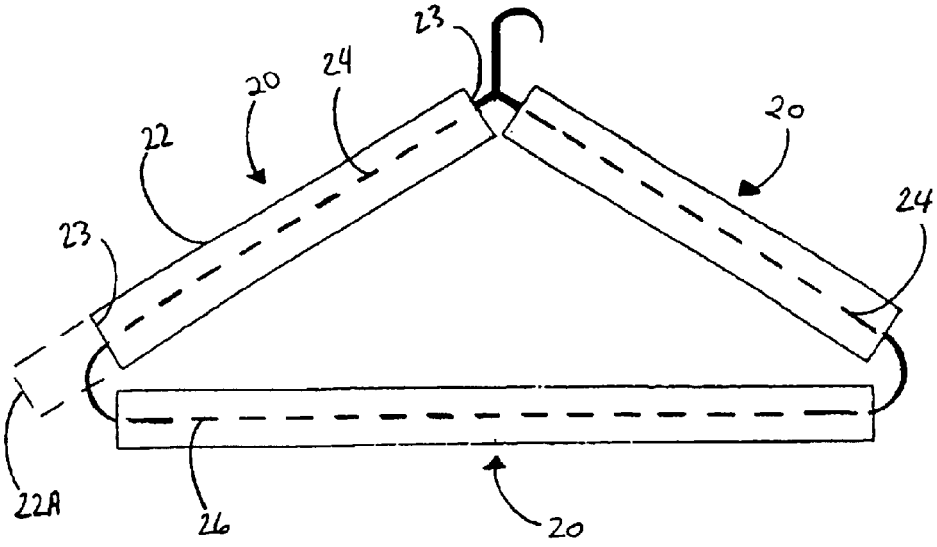
Figure 3:
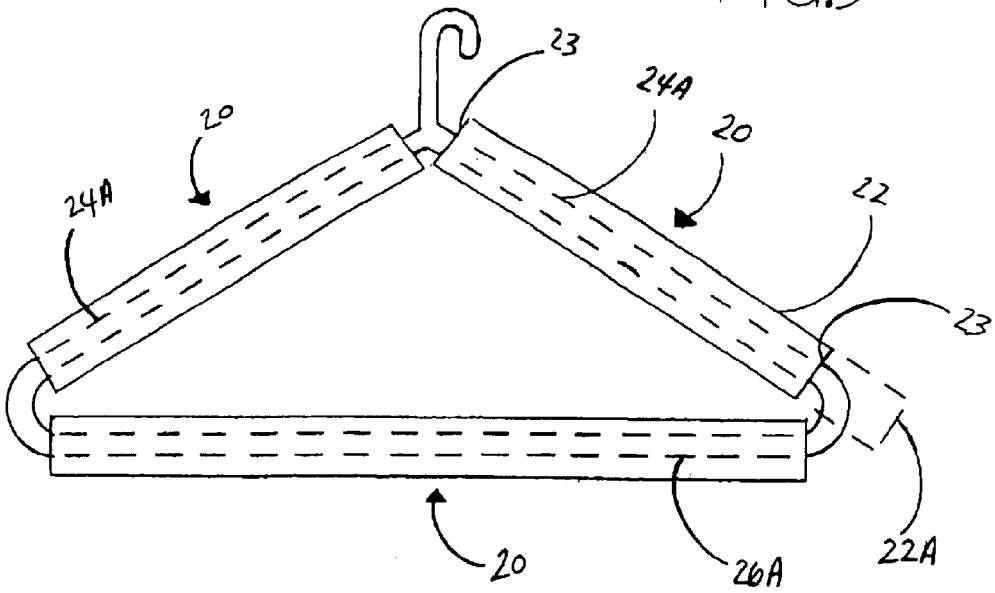
Figure 2A:
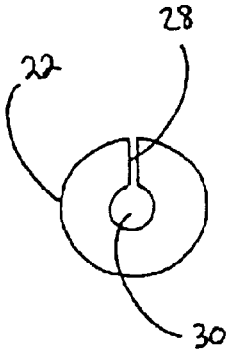
FIGS. 2A, 3A, and 3B are cross sectional views of preferred embodiments of the present invention.
Figure 3A:
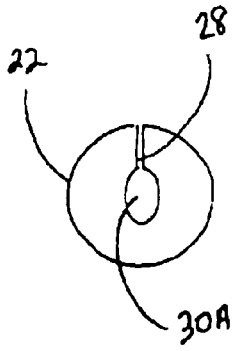
Figure 3B:
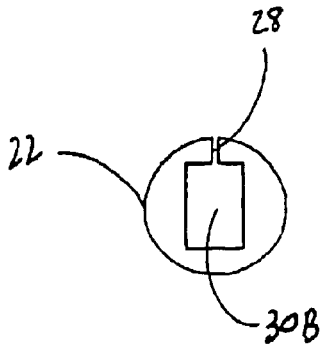
Figure 4:
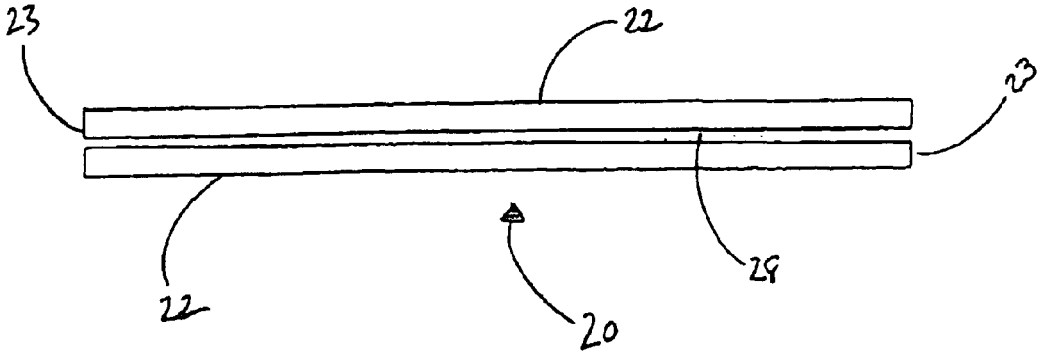
FIG. 4 is an orthographic bottom view of a preferred embodiment of the present invention.

FIGS. 1, 2, 2A, 3, 3A, 3B, and 4 show the plurality of crease and wrinkle prevention devices of the current invention, and show the devices 20 utilizing an injection moldable foamed material each integrally comprising, a cylindrical exterior circumference section 72 molded proportionally to a plurality of cylindrical ends 23, a molded opening 28 in section 22 spanning from one of the ends 23 to the other end 23, opening 28 transitioning to a cylindrical interior surface section 30, or a non cylindrical interior surface section 30A,30B, molded in the center interior of the devices 20. Section 22, opening 28, and section 30, 30A, 30B, molded proportionately in length. As shown in FIGS. 1, 2, and 3, the devices 20 having a fitting adjustment portion 22A, giving them a longer length than the horizontal arm 26,26A, and the plurality of side arms 24,24A of the clothes hanger. In the preferred embodiment, the device 20 for illustrative purposes, were cut out and sculpted from an injection molded polyethylene foamed swimming noodle purchased from pinch a penny pools, 8135 State Rd 52, Hudson Fla., 34667. However, they can be injection molded utilizing polyethylene, polyvinyl, chloride, rubber, pomalux, acetyl copolymer, polypropylene, nylon, or vinyl foamed materials.

The plurality of crease and wrinkle prevention devices 20 is a means for preventing unwanted creases and wrinkles in articles of clothing best suited for hanging in combination onto horizontal arm 26,26A, and side arms 24,24A, of the clothes hanger respectively; by allowing the articles of clothing to be installed and to rest onto section 22 that is cylindrically larger than arm 26,26A, and arms 24,24A, giving the installed portion of clothing a perfectly round, and larger surface to rest on, thus preventing unwanted creases and wrinkles caused by a small cylindrical surface of arm 26, and arms 24, or the smaller non-cylindrical surface of arm 26A, and arms 24A. The devices 20 install onto the clothes hanger, after cutting off a portion of each of the device 20 exceeding the length of whichever arm of the clothes hanger they are being installed onto. The longer length of the devices allowing their installation onto horizontal arms and side arms that vary in length resulting from differently manufactured clothes hangers, thus allowing the devices 20 to be easily installed onto a clothes hanger in an existing collection, and used when hanging articles of clothing such as pants and shirts in combination on the same hanger as many consumers do with regularity. The devices 20 removably install onto arm 26,26A and arms 24,24A through molded opening 28, with arm 26,26A and arms 24,24A resting within interior surface section 30,30A, section 30 molded slightly smaller in diameter than the cylindrical surface of arm 26, and arms 24, the section 30A molded slightly smaller in diameter than the non cylindrical surface of arm 26A, and arms 24A. Devices 20 securely contouring to arm 26,26A and arms 24,24A, section 30, 30A, 30B maintaining the cylindrical shape of section 22, by leaving no empty space to collapse in section 30, 30A, 30B of each of the installed devices 20 when hanging heavier articles of clothing, such collapsing creating a tendency for section 22 to have a less than perfect cylindrical shape, thus causing unwanted creases and wrinkles in installed articles of clothing. The devices 20 uninstall by pulling off and away from the clothes hanger with arm 26,26A and arms 24,24A exiting through opening 28, allowing the clothes hanger to return to its natural state, also allowing the removed devices to be used in combination on another clothes hanger.

From the description above, a number of advantages of our plurality of removably mountable crease and wrinkle prevention devices become evident. Our devices are lightweight and quickly and efficiently connect to and disconnect from, the horizontal arm and the side arms of the clothes hanger. Users may utilize the devices wherever and whenever they may travel. The design of our devices allows them to be used on clothes hangers having cylindrical or non-cylindrical surfaces. Our devices are effectively capable of solving the problem that consumers have, of how to make existing clothes hangers in their vast collection completely crease and wrinkle proof. The design of our devices allows a consumer to hang articles of clothing such as pants, and shirts, in combination, on the same hanger. The simplicity of design, along with the injection molding methods currently available, allows the manufacturing of our crease and wrinkle prevention devices to be truly cost effective, therefore reasonable to buy. Thus the reader will see that the crease and wrinkle prevention devices of the invention provide simple, lightweight, and integral devices, that are highly reliable as well as economical, that can be used by persons of almost any age, that have an interest in keeping their clothes free of unwanted creases, and wrinkles.

While our above description contains several specificities, these should not be construed as limitations on the scope of the invention, but rather as an exemplification of one preferred embodiment thereof. Other variations are possible. For example: (1) The crease and wrinkle prevention devices could be made larger, and longer, to accommodate larger articles of clothing, or pieces of fabrics. (2) The interior surface section could be molded to accommodate the shape, and size, of a plurality of side arms, and a horizontal arm, of any clothes hanger, currently manufactured, or, any clothes hanger manufactured in the future. (3) The molded opening could be made larger, or smaller, and could be brought together and closed, utilizing Velcro. (4) The crease and wrinkle prevention devices can be molded from any injection moldable foamed materials, or poured foamed materials, currently available, or available in the future. (5) The crease and wrinkle prevention devices can be modified, and mounted onto a weight bar, to be used as padding support for a person's back and shoulders when doing leg squats.

Therefore, without departing from the spirit and scope of this invention, one of ordinary skill in the art can make the foregoing modifications, and other changes and modifications to the plurality of crease and wrinkle prevention devices of the present invention, to adapt them to specific usages and conditions. As such, these changes and modifications are properly, equitably, and intended to be, within the full range of equivalents of the following claims.

What is claimed is:

1. A plurality of removably mountable crease and wrinkle prevention devices each integrally comprising;

a cylindrical exterior circumference section molded proportionally to a plurality of cylindrical ends, a molded opening in the exterior circumference section spanning from one of the cylindrical ends to the other cylindrical end, said opening transitioning to a cylindrical interior surface section molded in the center interior of the devices, the exterior circumference section, the molded opening, and the interior surface section molded proportionately in length creating a fitting adjustment portion, giving the devices a longer length than a horizontal arm or a plurality of side arms of a clothes hanger, said devices preventing unwanted creases and wrinkles in articles of clothing best suited for hanging in combination onto said horizontal arm, and said side arms of the clothes hanger respectively, by allowing the articles of clothing to be installed and to rest onto the exterior circumference section that is cylindrically larger than the horizontal arm and the side arms, giving the installed portion of clothing a perfectly round and larger surface to rest on, preventing unwanted creases and wrinkles caused by a smaller cylindrical surface, each of the devices install onto the clothes hanger through the molded opening, after cutting off a portion of each of the devices exceeding the length of whichever arm of the clothes hanger they are being installed onto, the longer length of the devices allowing their installation onto horizontal arms and side arms that vary in length resulting from differently manufactured clothes hangers, the horizontal arm and the side arms, resting within the cylindrical interior surface section molded slightly smaller in diameter than the horizontal arm and the side arms, said devices securely contouring to said horizontal arm and said side arms, the interior surface section maintaining the cylindrical shape of the exterior circumference section, by leaving no empty space to collapse in the interior surface section of each of the installed devices when hanging heavier articles of clothing, such collapsing creating a tendency for the exterior circumference section to have a less than perfect cylindrical shape, the devices uninstall by pulling off and away from the clothes hanger with the horizontal arm and the vertical arms exiting through the method opening of each of the devices, allowing the clothes hanger to return to it's natural state, also allowing the removed devices to be used in combination on another clothes hanger.

2. The plurality of crease and wrinkle prevention devices of claim 1 further comprising a non cylindrical interior surface section.

3. A plurality of removably mountable crease and wrinkle prevention devices each integrally comprising;

a cylindrical exterior circumference section molded proportionally to a plurality of cylindrical ends, a molded opening in the exterior circumference section spanning from one of the cylindrical ends to the other cylindrical end, said opening transitioning to a cylindrical interior surface section molded in the center interior of the devices, the exterior circumference section, the molded opening, and the interior surface section molded proportionately in length creating a fitting adjustment portion, giving the devices a longer length than a horizontal arm or a plurality of side arms of a clothes hanger, said devices preventing unwanted creases and wrinkles in articles of clothing best suited for hanging in combination onto said horizontal arm and said side arms of the clothes hanger respectively, by allowing the articles of clothing to be installed and to rest onto the exterior circumference section that is cylindrically larger than the horizontal arm and the side arms, giving the installed portion of clothing a perfectly round and larger surface to rest on, preventing unwanted creases and wrinkles caused by a smaller cylindrical surface, each of the devices install onto the clothes hanger through the molded opening, after cutting off a portion of each of the devices exceeding the length of whichever arm of the clothes hanger they are being installed onto, the longer length of the devices allowing their installation onto horizontal arms and side arms that vary in length resulting from differently manufactured clothes hangers, the horizontal arm and the side arms, resting within the cylindrical interior surface section molded slightly smaller in diameter than the horizontal arm and the side arms, said devices securely contouring to said horizontal arm, and said side arms, the devices uninstall by pulling off and away from the clothes hanger with the horizontal arm, and the vertical arms exiting through the molded opening of each of the devices, allowing the clothes hanger to return to it's natural state, also allowing the removed devices to be used in combination on another clothes hanger.

4. The plurality of crease and wrinkle prevention devices of claim 3 further comprising a non cylindrical interior surface section.

5. A plurality of removably mountable crease and wrinkle prevention devices each integrally comprising;

a cylindrical exterior circumference section molded proportionally to a plurality of cylindrical ends, a molded opening in the exterior circumference section spanning from one of the cylindrical ends to the other cylindrical end, said opening transitioning to a cylindrical interior surface section molded in the center interior of the devices, the exterior circumference section, the molded opening, and the interior surface section molded proportionately in length creating a fitting adjustment portion, giving the devices a longer length than a plurality of side arms or a horizontal arm of a clothes hanger, said devices preventing unwanted creases and wrinkles in articles of clothing best suited for hanging in combination onto said side arms and said horizontal arm of the clothes hanger, by allowing the articles of clothing to be installed and to rest onto the exterior circumference section that is cylindrically larger than the side arms and the horizontal arm, giving the installed portion of clothing a perfectly round and larger surface to rest on, preventing unwanted creases and wrinkles caused by a smaller cylindrical surface, each of the devices install onto the clothes hanger through the molded opening, after cutting off a portion of each of the devices exceeding the length of whichever arm of the clothes hanger they are being installed onto, the longer length of the devices allowing their installation onto side arms and horizontal arms that vary in length resulting from differently manufactured clothes hangers, the side arms and the horizontal arm resting within the cylindrical interior surface section molded slightly smaller in diameter than the side arm and the horizontal arm, said devices securely contouring to said side arms and said horizontal arm, the interior surface section maintaining the cylindrical shape of the exterior circumference section, by leaving no empty space to collapse in the interior surface section of each of the installed devices when hanging heavier articles of clothing, such collapsing creating a tendency for the exterior circumference section to have a less than perfect cylindrical shape, the devices uninstall by pulling off and away from the clothes hanger with the side arms and the horizontal arm exiting through the molded opening of each of the devices, allowing the clothes hanger to return to it's natural state, also allowing the removed devices to be used in combination on another clothes hanger.

6. The plurality of crease and wrinkle prevention devices of claim 5 further comprising a non cylindrical interior surface section.

7. A plurality of removably mountable crease and wrinkle prevention devices are integrally comprising;

a cylindrical exterior circumference section molded proportionally in a plurality of cylindrical ends, a molded opening to the exterior circumference section spanning from one of the cylindrical ends to the other cylindrical end, said opening transitioning to a cylindrical interior surface section molded in the center interior of the devices, the exterior circumference section, the molded opening, and the interior surface section molded proportionately in length creating a fitting adjustment portion, giving the devices a longer length than a plurality of side arms or a horizontal arm of a clothes hanger, said devices preventing unwanted creases and wrinkles in articles of clothing best suited for hanging in combination onto said side arms and said horizontal arm of the clothes hanger, by allowing the articles of clothing to be installed and to rest onto the exterior circumference section that is cylindrically larger than the side arms and the horizontal arm, giving the installed portion of clothing a perfectly round, and larger surface to rest on, preventing unwanted creases and wrinkles caused by a smaller cylindrical surface, each of the devices install onto the clothes hanger through the molded opening, after cutting off a portion of each of the devices exceeding the length of whichever arm of the clothes hanger they are being installed onto, the longer length of the devices allowing their installation onto side arms and horizontal arms that vary in length resulting from differently manufactured clothes hangers, the side arms and the horizontal arm resting within the cylindrical interior surface section molded slightly smaller in diameter than the side arms and the horizontal arm, said devices securely contouring to said side arms and said horizontal arm, the devices uninstall by pulling off and away from the clothes hanger with the side arms and the horizontal arm exiting through the molded opening of each of the devices, allowing the clothes hanger to return to it's natural state, also allowing the removed devices to be used in combination on another clothes hanger.

8. The plurality of crease and wrinkle prevention devices of claim 7 further comprising a non cylindrical interior surface section.

9. A plurality of removably mountable crease and wrinkle prevention devices each integrally comprising;

a cylindrical exterior circumference section molded proportionally to a plurality of cylindrical ends, a molded opening in the exterior circumference section spanning from one of the cylindrical ends to the other cylindrical end, said opening transitioning to a cylindrical interior surface section molded in the center interior of the device, the exterior circumference section, the molded opening, and the interior surface section molded proportionately in length creating a fitting adjustment portion, giving the device a longer length than a horizontal arm of a clothes hanger, said device preventing unwanted creases and wrinkles in the article of clothing best suited for hanging onto said horizontal arm of the clothes hanger, by allowing the article of clothing to be installed and to rest onto the exterior circumference section that is cylindrically larger than the horizontal arm, giving the installed portion of clothing a perfectly round and larger surface to rest on, preventing unwanted creases and wrinkles caused by a smaller cylindrical surface, the device installs onto the clothes hanger through the molded opening, after cutting off a portion of the device exceeding the length of the horizontal arm, the longer length of the device allowing it's installation onto horizontal arms that vary in length resulting from differently manufactured clothes hangers, the horizontal arm resting within the cylindrical interior surface section molded slightly smaller in diameter than the horizontal arm, said device securely contouring to said horizontal arm, the interior surface section maintaining the cylindrical shape of the exterior circumference section, by leaving no empty space to collapse in the interior surface section of the installed device when hanging the heavier article of clothing, such collapsing creating a tendency for the exterior circumference section to have a less than perfect cylindrical shape, the device uninstalls by pulling off and away from the clothes hanger with the horizontal arm exiting through the molded opening of the device, allowing the clothes hanger to return to it's natural state, also allowing the removed device to be used on another current hanger.

10. The crease and wrinkle prevention device of claim 9 further comprising a non cylindrical interior surface section.

11. A plurality of removably mountable crease and wrinkle prevention devices each integrally comprising;

a cylindrical exterior circumference section molded proportionally to a plurality of cylindrical ends, a molded opening in the exterior circumference section spanning from one of the cylindrical ends to the other cylindrical end, said opening transitioning to a cylindrical interior surface section molded in the center interior of the devices, the exterior circumference section, the molded opening, and the interior surface section molded proportionately in length creating a fitting adjustment portion, giving the devices a longer length than a plurality of side arms of a clothes hanger, said devices preventing unwanted creases and wrinkles in the article of clothing best suited for hanging onto said side arms of the clothes hanger, by allowing the article of clothing to be installed and to rest onto the exterior circumference section that is cylindrically larger than the side arms, giving the installed portion of clothing a perfectly round and larger surface to rest on, preventing unwanted creases and wrinkles caused by a smaller cylindrical surface, the devices install onto the clothes hanger through the molded opening, after cutting off a portion of the devices exceeding the length of the side arms, the longer length of the devices allowing their installation onto side arms that vary in length resulting from differently manufactured clothes hangers, the side arms resting within the cylindrical interior surface section molded slightly smaller in diameter than the side arms, said devices securely contouring to said side arms, the interior surface section maintaining the cylindrical shape of the exterior circumference section, by leaving no empty space to collapse in the interior surface section of the installed devices when hanging the heavier article of clothing, such collapsing creating a tendency for the exterior circumference section to have a less than perfect cylindrical shape, the devices uninstall by pulling off and away from the clothes hanger with the side arms exiting through the molded opening of the devices, allowing the clothes hanger to return to it's natural state, also allowing the removed devices to be used on another clothes hanger.

12. The plurality of crease and wrinkle prevention devices of claim 11 further comprising a non cylindrical interior surface section.

* * * * *